US005798038A

United States Patent [19]

Huber

[11] Patent Number: 5,798,038

[45] Date of Patent: Aug. 25, 1998

[54] DEVICE FOR REMOVING DEPOSITED MATERIAL FROM A LIQUID IN A FLUME

[75] Inventor: Hans Georg Huber, Berching, Germany

[73] Assignee: Hans Huber GmbH Maschinenund Anlagenbau, Berching, Germany

[21] Appl. No.: 677,489

[22] Filed: Jul. 9, 1996

[30] Foreign Application Priority Data

Jul. 15, 1995 [DE] Germany ..... 295 11 462.2

[51] Int. Cl.[6] ..... B01D 35/18; B01D 29/94; E02B 5/08; E02B 8/02

[52] U.S. Cl. ..... 210/154; 210/161; 210/162; 210/184; 198/670; 198/671; 198/952

[58] Field of Search ..... 210/161, 162, 210/184, 154; 198/670, 671, 952

[56] References Cited

U.S. PATENT DOCUMENTS

| | | | |
|---|---|---|---|
| 1,303,470 | 5/1919 | Gillette . | |
| 2,617,273 | 11/1952 | Findlay . | |
| 3,637,069 | 1/1972 | Christian . | |
| 4,009,667 | 3/1977 | Tyer . | |
| 4,530,432 | 7/1985 | Christian . | |
| 4,836,919 | 6/1989 | Huber . | |
| 4,859,322 | 8/1989 | Huber . | |
| 5,078,865 | 1/1992 | Huber . | |
| 5,122,263 | 6/1992 | Huber . | |
| 5,296,136 | 3/1994 | Abel . | |
| 5,341,826 | 8/1994 | Huber et al. . | |
| 5,372,713 | 12/1994 | Huber | 210/158 |

*Primary Examiner*—Thomas M. Lithgow
*Attorney, Agent, or Firm*—Thomas, Kayden, Horstemeyer & Risley

[57] ABSTRACT

A device for removing deposited material from a liquid in flume includes a conveyor for the deposited material that is disposed at an ague with respect to the plume and leads to a discarding point. The device includes a housing which houses a shaft and a conveyor screw mounted to the shaft. The shaft includes a hollow portion therein for housing a heater. The heater heats the conveyor for preventing material from freezing in the conveyor.

5 Claims, 1 Drawing Sheet

DEVICE FOR REMOVING DEPOSITED MATERIAL FROM A LIQUID IN A FLUME

FIELD OF THE INVENTION

The invention relates to a device for removing deposited material from a liquid in a flume, with a conveyor for the deposited material which is installed at an angle and leads to a discarding point, which is driven and which comprises a housing, a shaft and a conveyor screw and with a heating device to heat the deposited material carried upwards. This device is especially appropriate for use in sewage treatment plants, but which can also be employed in the textile industry, the plastics industry, in slaughter houses and the like, in fact always if a deposited material in a more or less solid form is to be removed from a liquid especially from water and here conditions can occur especially in winter time which can freeze the deposited material in the conveyor.

Such a device for removing deposited material from a liquid in a flume needs a depositing apparatus which has a separation area that is screened by the liquid to be cleaned. At this point this depositing apparatus is not important and can be formed however.

BACKGROUND OF THE INVENTION

The problem from which the present invention starts out from is following. The liquid in the flume usually has a temperature of 10° C. especially in sewage treatment plants, so that there is no danger of freezing. However, the device mentioned at the beginning comprises also parts, especially the conveyor transporting upwards at an angle or also vertically, which can outside and in winter time be exposed to temperatures below freezing point. Thus, the danger of freezing exists. This danger is increased by the fact that the conveyor usually does not work continuously, but discontinuously, with time intervals in which the deposited material rests in the conveyor that can be quite big.

An example of a prior art device for removing deposited material from a liquid in a flume is known that has besides the conveyor for transporting the deposited material a heating device to heat the deposited material carried out upwards. The heating device comprises a heater in form of a heating cable which is allocated at the outside of the housing of the conveyor. Here, the heating cable extends over essential parts of the axial length of the housing and over its circumference. The heater itself is covered by an insulating material that is supposed to keep the loss of heat to the outside relatively low. The insulating material is protected by a second housing which covers the insulating material. Thus, constructing the insulating material and the additional housing serving as a sheathing is considerable. The heat really effecting the deposited material is not satisfying because of the occurring losses.

SUMMARY OF THE INVENTION

Therefore, it is an object of the invention to provide a device of the already described manner which uses better the energy produced by the heater.

According to the invention this can be achieved by the shaft being a hollow shaft at least at the discarding point and by heater being arranged in the hollow shaft.

The invention relies on the thought not to arrange the heater on the outside, i.e. on the outside of the housing of the conveyor any more but in the centre or in the axis of the shaft of the conveyor. Therefore, the shaft is a hollow shaft which can easily be achieved by a tube used as the shaft on the outer circumference of which the conveyor screw is arranged. The so built interior serves for the arrangement of heater of the heating device. Normally, an electric heater will be used so that electric energy easily can be led through the hollow shaft to the heater. But there is also the possibility to form the heater as a conduit and to use for example the liquid of the flume and their temperature for heating. By providing the heat in the centre of the conveyor the heat can be much better transmitted. In fact, partially the heat will be lost to the outside, but the whole heat produced is used to keep the according parts of the conveyor and thus the for example deposited material resting on the conveyor screw on temperature. Therefore, the heat is transmitted from the endangered parts from the conveyor screw to the deposited material by heat transmission. As known, a gap between the conveyor screw and the housing is provided the insulating effect of which can be advantageously used to keep losses small. On the other hand, more heat from the deposited material to the housing is transmitted by the direct contact between the conveyor screw, the resting deposited material and the housing so that freezing can be avoided.

The heater can be fixed in the hollow shaft. Thereby, the heater can be formed like a bar. It is possible to support the fixed heater by one or more bearings with respect to the turning hollow shaft.

But it is also possible that the heater turns the hollow shaft and that for power supply of the heater a slip ring is provided. The power supply in form of electric energy is here effected by a slip ring which is arranged on the hollow shaft. This arrangement with the turning heater enables to hold the heater right next to the inner wall of the hollow shaft.

However, both arrangements enable providing a heat transfer medium, especially a liquid, in the hollow shaft for better heat transmission.

This heat transfer medium serves to connect the surface of the heater with the inner surface of the hollow shaft and thus favours heat transmission. In the simplest embodiment the heat transfer medium is a liquid. But also an easy meltable salt can be used. Here, the advantage is used that the amount of heat needed to change the state of aggregation can be used for storage purpose so that the temperature of the heat transfer medium stays constant.

To drive the hollow shaft with the conveyor screw a motor can be allocated at the upper ending of the hollow shaft the shaft of which is born through to supply especially electric energy. The supply of energy is then effected by the born through shaft of the motor with direct connection to the hollow shaft of the conveyor. This happens not only if electric energy is provided but also if a liquid that serves for heating is led by a pump over a conduit through the hollow shaft.

The housing of the conveyor can be surrounded by an insulating material. Thus, radiation loss and confection loss are lessened.

The conveyor may comprise a drain cover having openings and being positioned upstream the discarding point. The drain cover consists of insulating material, especially polyurethane. Here a compacting zone for the deposited material is formed and the liquid may pass through the openings of the drain cover back into the flume.

BRIEF DESCRIPTION OF THE DRAWINGS

The invention is further described and explained by a preferred embodiment. It is.

DETAILED DESCRIPTION

Figure 1:
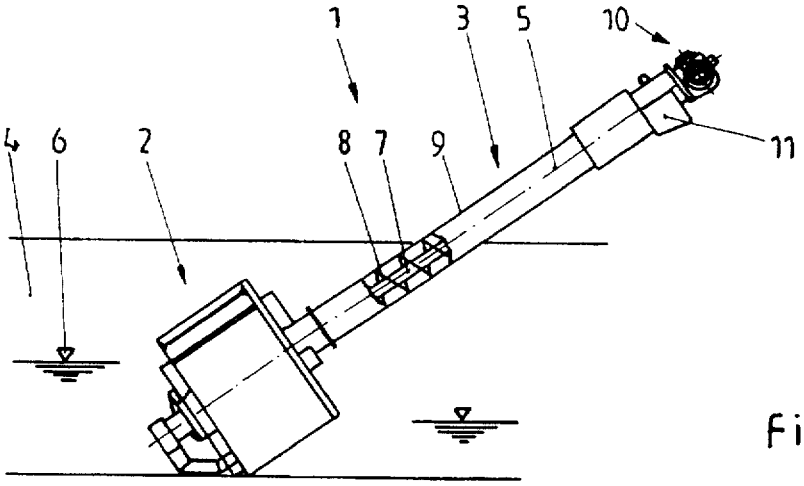
FIG. 1 a schematic side view of the whole device.

FIG. 1 represents a device 1 which mainly comprises a depositing apparatus 2 and conveyor 3. The device 1 is installed at an angle in a flume 4 with their common axis 5 in that way that one part of the depositing apparatus 2 is below the liquid level 6 while the conveyor 3 is arranged at least with its upper part above the liquid level 6 and leads out of the flume 4.

The conveyor 3 comprises a hollow shaft 7, a conveyor screw 8 and a housing 9 which surrounds the conveyor screw 8 tube-like. At the upper ending of the hollow shaft 7 a motor 10 is arranged that serves to drive the hollow shaft 7 with the conveyor screw 8. A discarding point 11 is provided at the upper part of the conveyor 3 which enables for example as a throw-of chute to throw the deposited material into a container. Just upstream the discarding point 11 a compacting zone for the deposited material 15 is formed. A drain cover 19 having openings is positioned there. The drain cover 19 consists of insulating material, especially polyurethane.

Figure 2:
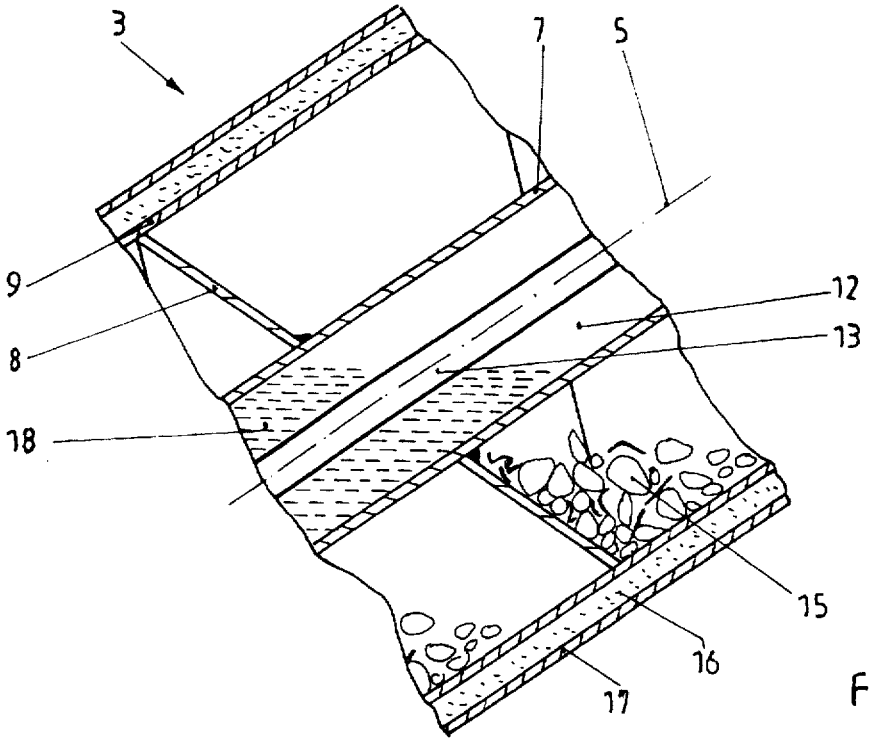
FIG. 2 a section view of a part of the conveyor.
Figure 3:
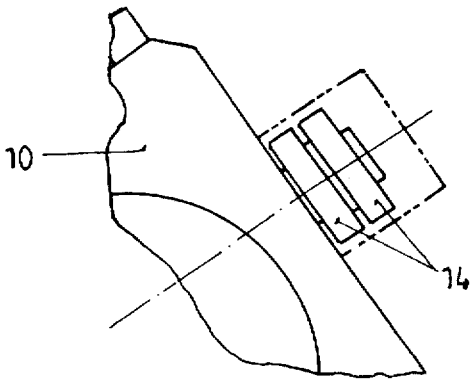
FIG. 3 the upper ending of the conveyor with its drive and the power supply.

The conveyor 3 has at least in its upper part which especially in winter is exposed to temperatures below freezing point, a heating device of which the essential parts are arranged in the interior 12 of the hollow shaft 7. FIG. 2 shows a heater 13 that is formed like a bar. Also heating cables or similar can be arranged here. The supply of usually electric power is effected through the hollow shaft 7 from its upper ending. FIG. 3 illustrates the ending of the motor 10 set up on top. The shaft of the motor 10 is also hollow, i.e. drilled through. A slip ring 14 serves for the supply of electric energy of the heater 13 is arranged revolving in the interior 12 of the hollow shaft 7. But it is also possible to fix the heater so that also the energy supply is provided without any movement.

FIG. 2 shows how the deposited material 15 partially can be stored on the conveyor screw 8 and partially on the wall of the housing 9, at least at times when the conveyor 3 is not driven. As known here a drive at intervals is effected with more or less long intervals of standing still. The housing 9 of the conveyor 3 can be surrounded by an insulating material 16 which preferably is protected by a sheathing 17.

FIG. 2 illustrates that the interior 12 of the hollow shaft 7 can be filled totally or partially with a heat transfer medium 18 which surrounds the heater 13 and enables a better flow of heat to the hollow shaft 7. The heat transfer medium can be a liquid but also a PCM device, for example salt, which changes into a fluid state of aggregation at a comparatively low heating temperature.

LIST OF REFERENCES

| | |
|---|---|
| 1 - Device | 11 - Discarding point |
| 2 - Deporting apparatus | 12 - Interior |
| 3 - Conveyor | 13 - Heater |
| 4 - Flume | 14 - Slip ring |
| 5 - Axis | 15 - Deposited material |
| 6 - Liquid level | 16 - Insulating material |
| 7 - Hollow shaft | 17 - Sheathing |
| 8 - Conveyor screw | 18 - Heat transfer medium |
| 9 - Housing | 19 - Drain cover |
| 10 - Motor | |

I claim:

1. A device for removing deposited material (15) from a liquid in a flume (4), said device comprising:

a conveyor (3) for transporting the deposited material (15), wherein said conveyor is constructed and arranged to be installed at an angle in a flume and extend upwardly from a flume to a discarding point (11), said conveyor comprising a housing (9), a driven hollow shaft (7) in said housing, a conveyor screw (8) surrounding said hollow shaft and driven with said hollow shaft for carrying deposited material upwards in said housing about said hollow shaft;

a heater (13) in said hollow shaft and rotatable with said hollow shaft to heat the deposited material (15) carried upwards about said hollow shaft, and a slip ring (14) arranged to revolve with said hollow shaft for providing electrical energy to the heater (13);

wherein said heater is adapted and configured to generate beat energy within said hollow shaft.

2. The device of claim 1, wherein the heater (13) is fixed in the hollow shaft (7).

3. The device of claim 1, wherein for better transmission of heat in the hollow shaft (7) a liquid heat transfer medium (18) is arranged in the hollow shaft (7).

4. The device of claim 1, wherein the housing (9) of the conveyor (3) is surrounded by an insulating material (16).

5. The device of claim 1, wherein the conveyor (3) comprises a drain cover (19) having openings and being positioned upstream of the discarding point (11).

* * * * *